US006422752B1

(12) United States Patent
Hoffner et al.

(10) Patent No.: US 6,422,752 B1
(45) Date of Patent: Jul. 23, 2002

(54) FLEXIBLE ALL-IN-ONE BAG

(76) Inventors: Thomas Joseph Hoffner, 9363 Walker St., Philadelphia, PA (US) 19114; Kathleen Hoffner, 90 W. Greenbush Rd., Tuckerton, NJ (US) 08087

( * ) Notice: Subject to any disclaimer, the term of this patent is extended or adjusted under 35 U.S.C. 154(b) by 0 days.

(21) Appl. No.: 09/793,746

(22) Filed: Feb. 27, 2001

(51) Int. Cl.[7] ..... B65D 33/02; B65D 33/10
(52) U.S. Cl. ..... 383/7; 383/15; 383/88
(58) Field of Search ..... 383/905, 88, 89, 383/90, 91, 7, 15

(56) References Cited

U.S. PATENT DOCUMENTS

| | | | | | |
|---|---|---|---|---|---|
| 612,107 | A | * | 10/1898 | Hutchens | 383/90 |
| 835,455 | A | * | 11/1906 | Mortensen | 383/90 |
| 3,052,399 | A | * | 9/1962 | Brown | 383/90 |
| 3,066,846 | A | * | 12/1962 | Comigan | 383/90 |
| 3,784,087 | A | * | 1/1974 | Styers | 383/90 |
| 4,267,768 | A | * | 5/1981 | Cieslak et al. | 383/905 |
| 5,215,797 | A | * | 6/1993 | Larsen et al. | 383/89 |
| 5,743,652 | A | * | 4/1998 | Dopps | 383/89 |
| 5,766,399 | A | * | 6/1998 | Clark | 383/905 |

FOREIGN PATENT DOCUMENTS

| | | | | |
|---|---|---|---|---|
| FR | 1221819 | * | 6/1960 | 383/905 |
| JP | 2-242750 | * | 9/1990 | 383/905 |
| JP | 4-142258 | * | 5/1992 | 383/88 |

* cited by examiner

*Primary Examiner*—Stephen P. Garbe
(74) *Attorney, Agent, or Firm*—Akin, Gump, Strauss, Hauer & Feld, L.L.P.

(57) ABSTRACT

A flexible bag includes a front wall and a rear wall that are sealed together at their longitudinal side edges. A lower end of the bag is closed, while an upper end of the bag forms a mouth that can be repeatably opened and closed. A flexible wire is embedded in each of the sealed side edges and extends along the length of the bag. After inserting one or more items in the bag, either side of the upper end of the bag is clasped and the bag is rotated around an axis parallel with the bag upper end in either a clockwise or counterclockwise direction. Rotation of the bag in this manner causes the wires and the material in which they are embedded to coil around the axis and seal the upper end of the bag. Tabs that are formed during this process can then be bent upward and connected together to form a handle which can then be heat sealed. In this manner, the bag cannot be opened until the seal is broken.

3 Claims, 5 Drawing Sheets

FLEXIBLE ALL-IN-ONE BAG

BACKGROUND OF THE INVENTION

The invention relates to the art of packaging and, more specifically, to a flexible bag and method of use for repetitive opening and closing.

Already existing are various flaccid and pliable containers used for packaging and storing edible as well as non-edible products. These bags are generally sealed at both ends while being initially packaged, and then one end is opened for accessibility. When consumers open and reuse a previously sealed item containing edibles, the duration of shelve life decreases significantly, generally due to the inability of a complete seal. Thus, the next time the package is accessed, the edibles have since become stale and/or spoiled, providing for needless waste, due in part to an inability to completely reseal the package.

Various solutions to this dilemma include providing different kinds of closure designs at the openable end, e.g. chip clips and ties, both of which easily become misplaced as they are not combined with the packaging. Other seals tend to seal partially, but not always completely. Zip-lock or compression type closures seemed to provide the most complete seal, but both require manual dexterity as well as time and patience.

Accordingly, there is a need in the art for a convenient, effective, easy, inexpensive bag, which incorporates an opening, closing, sealing, conveying and displaying system for use in packaging edible as well as non-edible items.

SUMMARY OF THE INVENTION

According to the invention, a flexible bag comprises front and rear walls that are sealed together at opposite longitudinally extending side seams, a closed lower end and extending between the side seams, an upper end formed by the front and rear walls between the side seams, the upper end being adapted for opening and closing, a wire embedded in and extending longitudinally along each side seam, and a pair of tabs formed by rotating the bag around an axis parallel to the bag upper end in one of a clockwise and counterclockwise direction such that the upper end is rolled about itself to thereby close the upper end.

Additional advantages, objects, and features of the present invention will evidence upon review of the following detailed description of preferred embodiments thereof when taken in conjunction with the drawings.

DETAILED DESCRIPTION OF THE PREFERRED EMBODIMENTS

Figure 1:
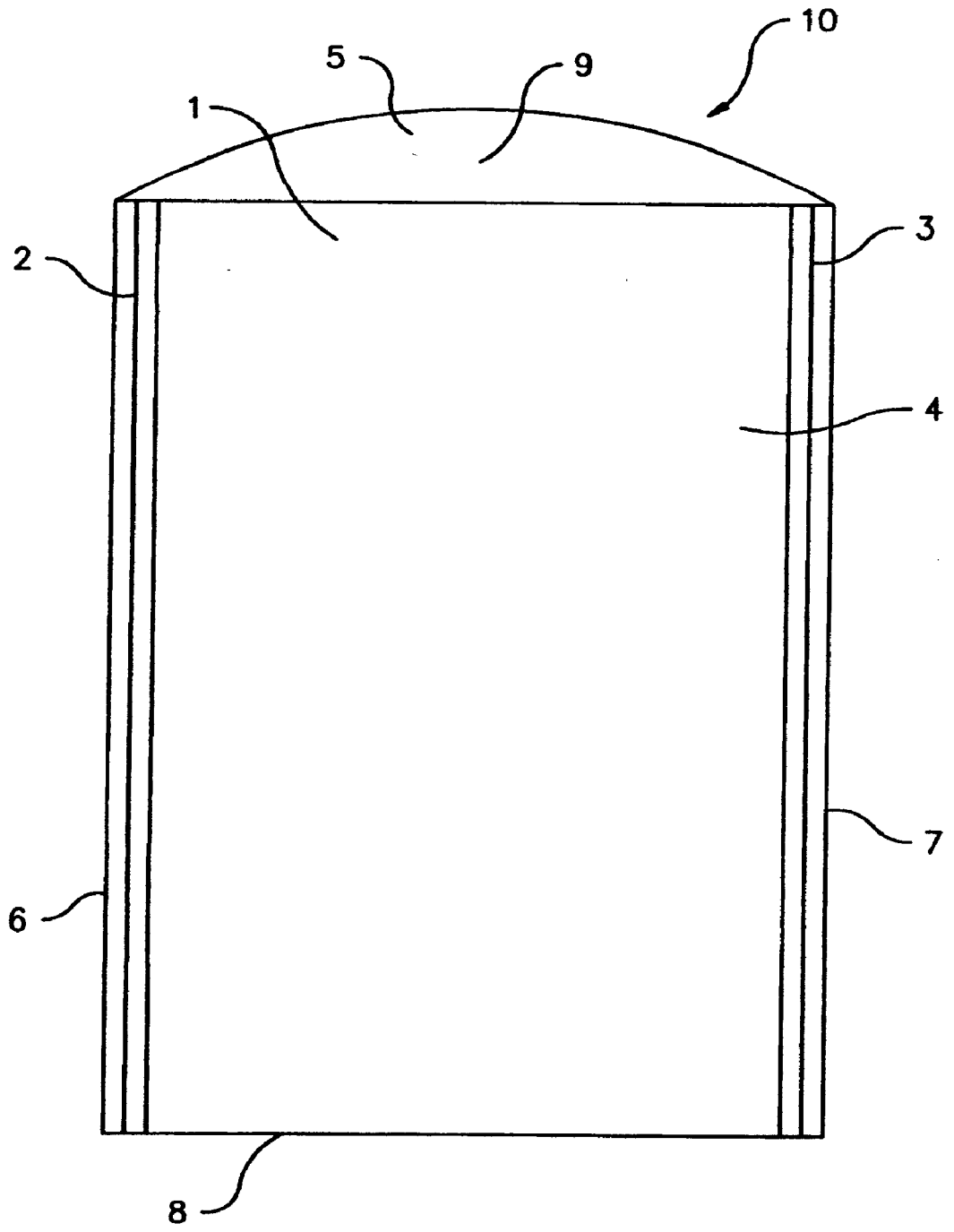
FIG. 1 is a front elevational view of a bag in accordance with a first embodiment of the present invention.
Figure 2:
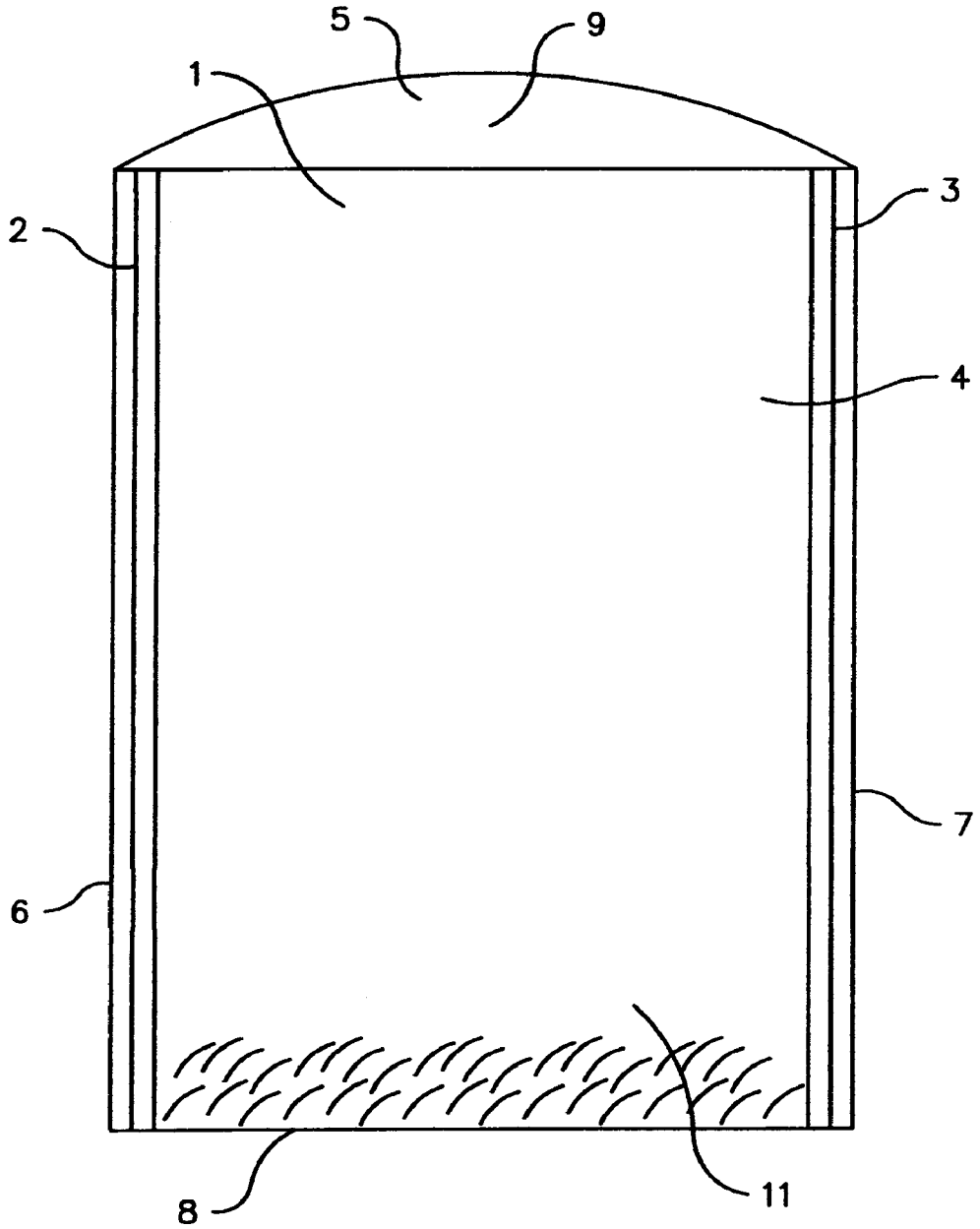
FIG. 2 is a front elevational view of the bag partially filled with contents.

With reference now to the drawings, and to FIGS. 1 and 2 in particular, a bag 10 according to a first embodiment of the present invention comprises a sheet 1 of film that is folded at a bottom edge 8 to form a front wall 4 and a rear wall 5. The front and rear walls are connected together at longitudinal side seams 6 and 7 to form a mouth 9 for filling the bag interior with food or other items 11 and for removing the items from the bag 10. A first wire 2 is encased in the side seam 6 and a second wire 3 is encased in the side seam 7. In the preferred form of the invention. the two encased wires are formed of wire sheathed in plastic, but other materials could be used. It should be noted that encased wires 2 and 3 can be attached, either directly or indirectly, to the sheet 1 in various ways, such as stitching, mechanical fasteners, and various types of adhesives, including pressure sensitive, heat activated and double-sided tapes.

Bags which are made from sheeted film are commonly referred to in the art as side seal or side weld bags and are usually sold to packers as finished bags that are often hand loaded before being sealed shut. The bag 10 could be formed from J-sheeted film after which the encased wire 2 and encased wire 3 can be attached by a machine, which is inline with the bag forming process.

Any conventional bag making film known in the art may be utilized as the film stock to make the bag 10. Such bag film is commonly referred to as plastic film, and is commonly made from polymeric or polyolefin materials such as polyethylene. The seals and seams of the invention are preferably made by heat sealing, but any other well known methods of securing polymeric materials together such as applying adhesives could also be utilized. Although the bag 10 is preferably constructed of plastic material, other materials can be used, such as paper, foils, laminated structures, leather, cloth and the like without deviating from the invention.

Figure 3:
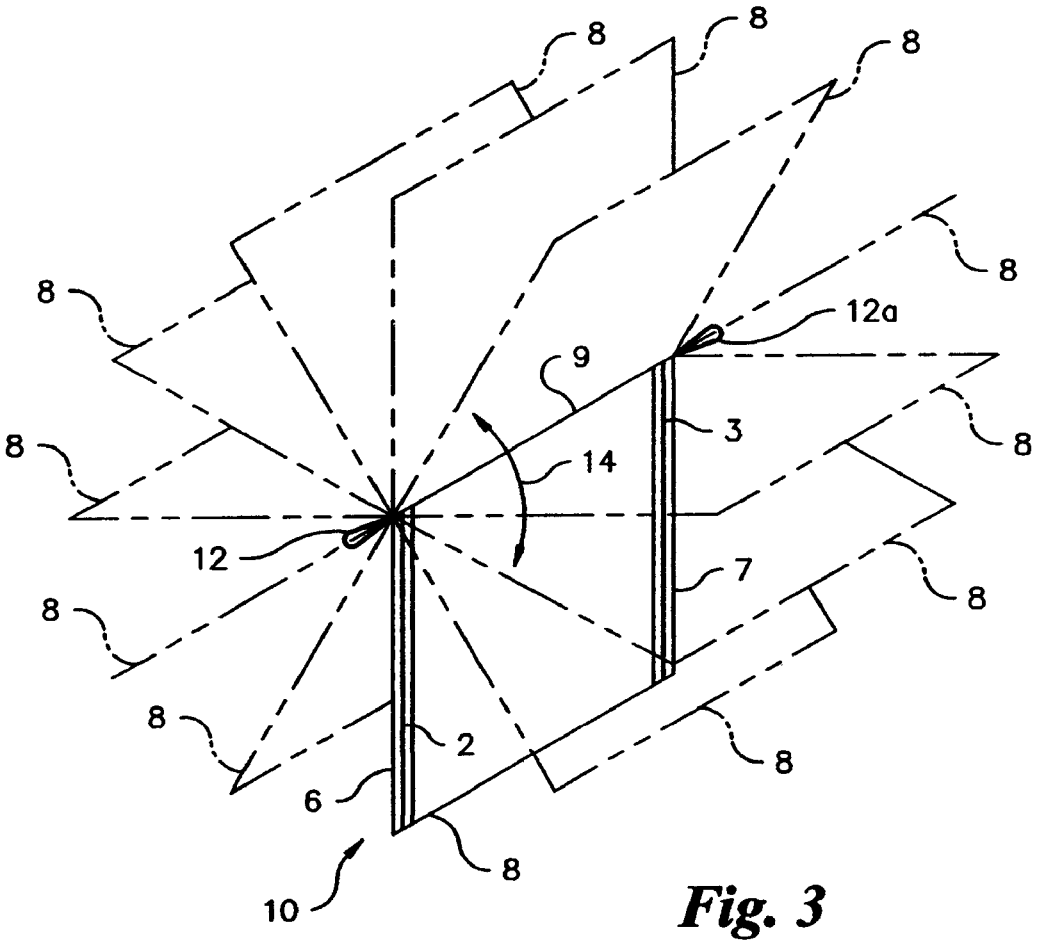
FIG. 3 is a perspective view of the bag shown during bag opening and closing, with different positions of the bag represented by phantom line.

In use, as shown in FIG. 3, after inserting item(s) 11 into the bag 10, either side of the bag at the mouth 9 is clasped and the bag is rotated in a clockwise or counterclockwise direction as denoted by arrow 14. During rotation, the bag material 10 and the wires 2 and 3 coil about the mouth 9 with each rotation and seal any contents located within the bag 10. Initial rotation of the bag 10 in either the clockwise or counterclockwise direction forms appendages or tabs 12 and 12*a* at the upper end of the longitudinal side seams 6 and 7, respectively.

Figure 4:
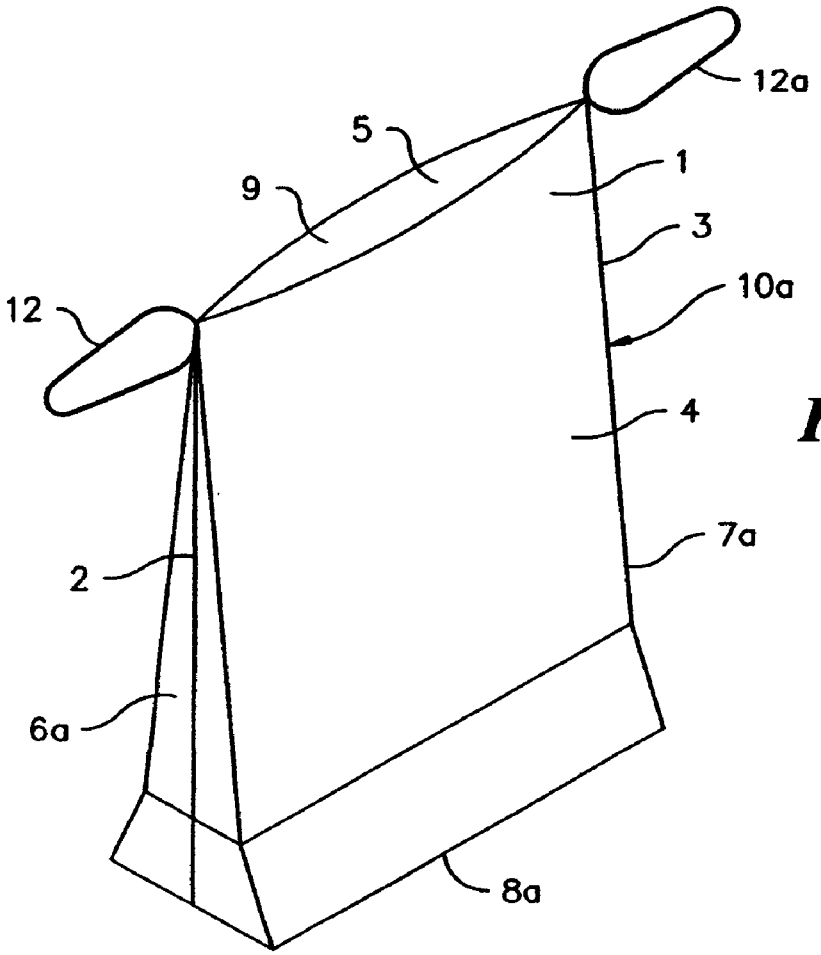
FIG. 4 is a perspective view of a bag in an open condition according to a further embodiment of the invention with two formed appendages.
Figure 5:
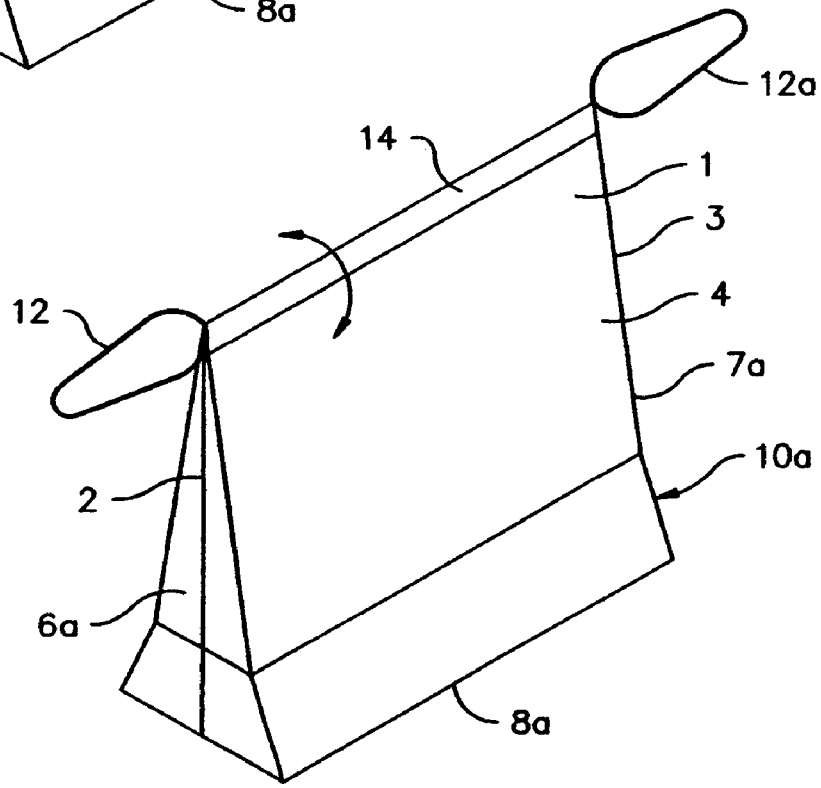
FIG. 5 is a perspective view of the bag of FIG. 4 in a closed condition after rotation of the appendages.

With reference now to FIGS. 4 and 5, a bag 10A according to a further embodiment of the invention is illustrated, wherein like parts in the previous embodiment are represented by like numerals. In this embodiment, the bag 10A has a wide base 8A that is connected to the front wall 4 and rear wall 5. A pair of side walls 6A and 7A extend from opposite sides of the base 8A between the front wall 4 and rear wall 5. Wires 2 and 3 (not shown) can be connected to the side walls 6A and 7A, respectively, in a similar manner as the FIG. 1 embodiment. The appendages 12 and 12*a*, as shown in FIG. 7, can be formed by bending an extension of the wires outwardly from the side walls 6A and 7A. In order to open or close the bag 10A, the bag can be clasped and rotated in a manner similar to the bag 10 as shown in FIG. 3.

Figure 6:
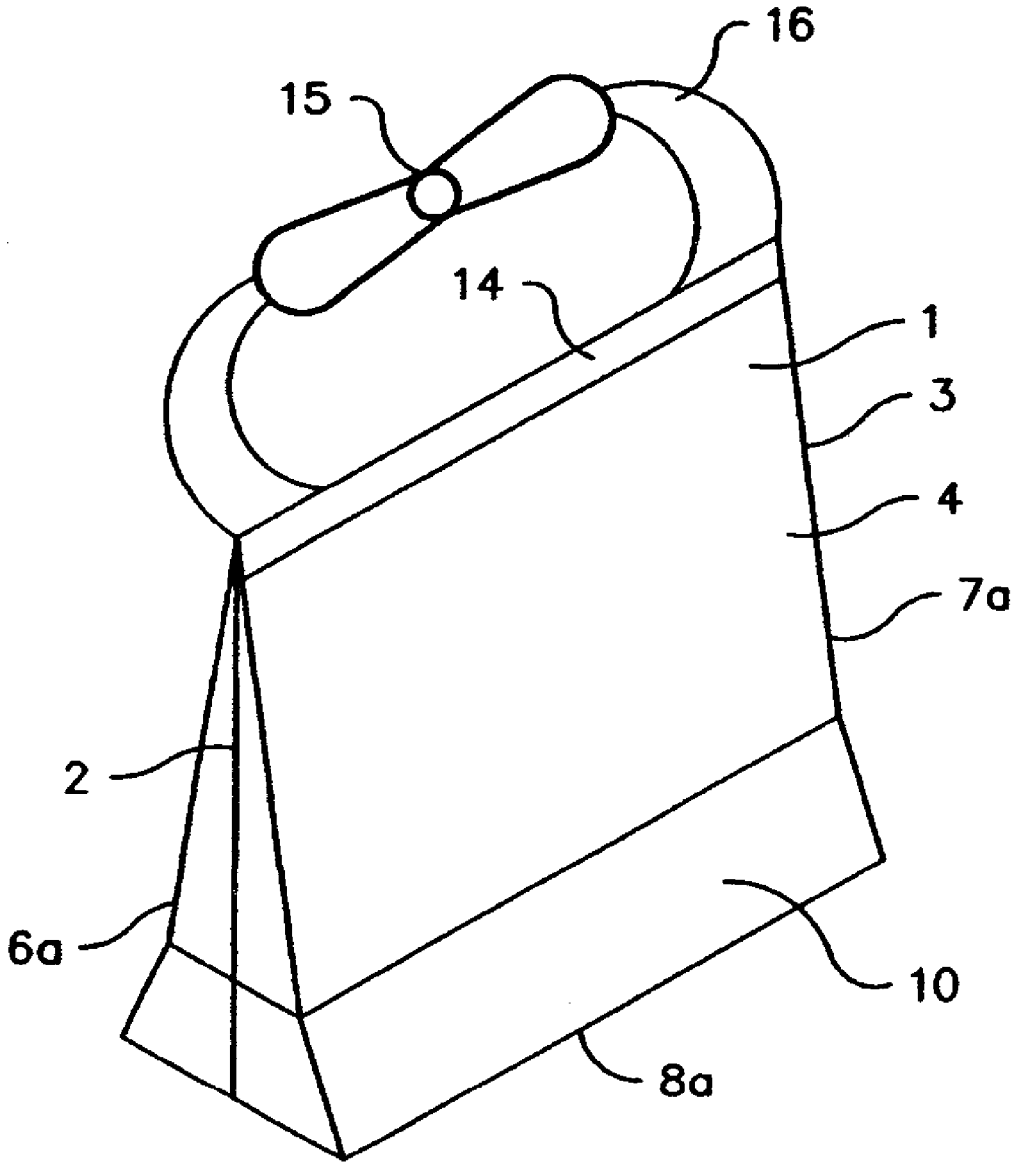
FIG. 6 is a perspective view of the bag of FIG. 4 in a closed condition with the appendages connected together to form a handle.

Once the appendages 12 and 12*a* are formed, and the bag 10A is sealed at the mouth 9 to form a seam 14 by rotating the bag around an axis parallel with the mouth 9, the appendages can be turned upright and placed transversely to form a handle 16, as shown in FIG. 6, for carrying and/or displaying the bag. The material surrounding the appendages can be heat sealed together in a well-known manner, to form a secondary seal which cannot be unwound until the seal is broken. Once the seal is broken, the bag can be repetitively opened and closed by twisting and untwisting the tabs, respectively, and by rotating the bag either clockwise or counterclockwise as shown in FIG. 3.

Although the preferred embodiments of the invention have been described in detail above, it should be understood that the invention is in no sense limited thereby. Accordingly, the scope of the invention should be determined not by the embodiments illustrated, but by the following appended claims and their legal equivalents.

We claim:

1. A flexible bag comprising:

front and rear walls that are sealed together at opposite longitudinally extending side seams;

a closed lower end extending between the side seams;

an upper end formed by the front and rear walls between the side seams, the upper end being adapted for opening and closing;

a wire embedded in and extending longitudinally along each side seam; and a pair of tabs formed by rotating the bag around an axis parallel to the bag upper end in one of a clockwise and counterclockwise direction such that the upper end is rolled about itself to thereby close the upper end, with the tabs being bent toward each other in overlapping relation and heat sealed to thereby form a handle that extends from the upper end and prevent opening of the bag.

2. A flexible bag according to claim 1, wherein the wires are coiled at least in the vicinity of the tabs during rotation of the bag around the axis.

3. A flexible bag according to claim 1, wherein the front and rear walls are integrally formed from a single sheet of material.

* * * * *